US005774030A

United States Patent [19]

Gray

[11] Patent Number: 5,774,030

[45] Date of Patent: Jun. 30, 1998

[54] PARALLEL AXIS CYLINDRICAL MICROWAVE FILTER

[75] Inventor: Devon J. Gray, Torrance, Calif.

[73] Assignee: Hughes Electronics Corporation, Los Angeles, Calif.

[21] Appl. No.: 829,634

[22] Filed: Mar. 31, 1997

[51] Int. Cl.[6] ..... H01P 1/208

[52] U.S. Cl. ..... 333/212; 333/135

[58] Field of Search ..... 333/208–212, 333/227, 228, 229, 230, 126, 132, 135

[56] References Cited

U.S. PATENT DOCUMENTS

| | | | |
|---|---|---|---|
| 4,725,797 | 2/1988 | Thompson et al. | 333/212 |
| 4,734,665 | 3/1988 | Rosenberg et al. | 333/212 |
| 5,254,963 | 10/1993 | Bonetti et al. | 333/212 X |
| 5,374,911 | 12/1994 | Kich et al. | 333/212 X |

FOREIGN PATENT DOCUMENTS

| | | | |
|---|---|---|---|
| 2675952 | 10/1992 | France | 333/212 |

*Primary Examiner*—Seungsook Ham
*Attorney, Agent, or Firm*—Terje Gudmestad; M. W. Sales

[57] ABSTRACT

A microwave filter includes two resonant cylindrical cavities aligned in parallel along their longitudinal axes, with the cavities offset by one half the cavities' resonant wavelength with respect to one another. Signals to be filtered are coupled into a first, input, cavity through an input coupling and between the input cavity and a second, output, cavity through bridge and mainline couplings formed in a common cavity wall.

23 Claims, 5 Drawing Sheets

PARALLEL AXIS CYLINDRICAL MICROWAVE FILTER

BACKGROUND OF THE INVENTION

1. Field of the Invention

The invention relates to microwave filters and, in particular, to right cylinder microwave filters.

2. Description of the Related Art

Microwave filters are widely known and employed, for example, to separate a communications satellite's received signal into separate bands for amplification and, after amplification, to provide channel separation for the amplified signals which are combined by a multiplexer for retransmission. Typically the microwave filters employed by satellites are multi-mode filters. Multi-mode filters are discussed, for example, in U.S. Pat. No. 4,410,865 issued to Frederick A. Young.

Microwave filters are generally constructed from conductive cavities of rectangular, cylindrical or spherical shape. Filters consisting of a single cavity or a plurality of linked cavities are common in the prior art. Single cavity responses generally are not acceptable for satellite output multiplexer applications because the out-of-band electromagnetic energy is not attenuated sharply enough to provide desirable channel separation. However, one may link together multiple cavities to produce, for example, quasi-elliptical filters which provide the desirable sharp attenuation of out-of-band energy. Filters, including quasi-elliptic filters, are discussed in Donald Fink, Donald Christiansen, eds, *Electronics Engineers' Handbook,* McGraw Hill Book Company, New York, 1989, pp12-5 through 12-30.

Because they are relatively light-weight and occupy less space than single mode filters, multi-mode filters, such as dual mode cylindrical filters, are particularly suitable for application in a spacecraft environment where weight and space are always at a premium. Dual mode filters employ resonant cavities which preferentially support two modes, or electric field contours, within the cavities. In the case of a cylindrical cavity resonator, the electric field of one mode is orthogonal to that of the other. To obtain a desired frequency response, a signal is introduced to one or more resonant cavities and, since the cavities support resonances at frequencies which correspond to an integral multiple of the mode's half-wavelength, signal components at frequencies other than those corresponding to the mode wavelength are attenuated.

In a dual mode cavity the mode which corresponds to the injected signal, hereinafter referred to as the primary mode, is perturbed by a conductive discontinuity within the resonator wall to create another orthogonal mode, referred to hereinafter as the secondary mode. Generally, a coupling screw situated at a 45° angle to the primary mode electric field (E field) couples energy from the primary mode E field to the secondary mode E field. Since the depth to which the coupling screw penetrates the cavity determines the degree of coupling, the amount of coupling may be adjusted by adjusting the coupling screw.

Because a dual mode resonant cavity can support two resonant modes in this fashion, a single cavity may be employed to implement a two section filter and higher order filters may be implemented by combining cavities; a four section filter may be created using only two resonant cavities, a six section filter would require only three cavities, etc. Cavities are combined by providing an aperture in a common wall through which the magnetic field (H field) of one mode may couple through to an adjacent cavity, thereby establishing a corresponding H field in the coupled cavity. Two types of coupling, generally referred to as "mainline" and "bridge" couplings are employed to couple energy between sequential and nonsequential modes, respectively. Sequential modes within adjacent cavities possess the same E field polarization; nonsequential modes are characterized by orthogonal E field polarization.

Although conventional dual mode resonators provide significant space and weight advantages over single mode resonators, further footprint reduction, better thermal management and more effective mode suppression would all be welcome improvements. That is, conventional dual mode cylindrical filters are generally configured as a combination of resonant cavities arranged along a single longitudinal axis. Although this arrangement of cavities consumes only half the surface area, or footprint, of a mounting plate that single mode cavities would require, spacecraft "real estate" is always precious and any reduction of filters' real estate requirements would permit other spacecraft systems to use the additional space. Although thermal compensation techniques are available, see U.S. Pat. No. 4,677,403 issued to Rolf Kich as an example, to provide optimal performance a substantial portion of the heat generated within resonant cavities must be conducted away from the cavity to prevent frequency shifts and other deleterious effects. It is sometimes difficult to conduct the heat generated within resonant cavities to a mounting plate or similar heat sink; a more compact arrangement of cavities would permit more efficient heat conduction. Additionally, since a resonant cavity will typically support a number of higher-order undesirable modes in addition to the primary and secondary modes of interest, a filter's performance can be degraded by inadvertently coupling energy from these modes from cavity to cavity.

SUMMARY OF THE INVENTION

The invention is directed to microwave filters which employ higher-order TE11X modes with minimal interference from other, unwanted, modes. The filters also provide an efficient thermal conduction path, permit the use of temperature compensation devices, and may be configured to occupy a smaller a footprint than conventional filters providing comparable performance. The structure of a preferred embodiment of the filter provides an efficient thermal path from the filter to a supporting surface, which typically will act as a heat sink.

In a preferred embodiment, a microwave filter includes two resonant cylinders aligned in parallel along their longitudinal axes, with the cylinders offset with respect to one another by one half the cylinders' resonant wavelength. The cylinders each support resonances of the form TE11x, i.e., two transverse electric field modes, one primary the other secondary, each of which includes an integer number (greater than or equal to three) of half wavelengths along the cylinders' longitudinal axes. Energy is coupled from modes within one cylinder to modes within the other cylinder through mainline and bridge apertures formed within a wall which is common to the two cylinders. Each cylinder is closed at either end by endwalls, with an aperture formed in one endwall of an input cylinder to form an input coupling and an aperture formed in the opposite end of the output cylinder to form the filter's output coupling. Those endwalls which have neither input nor output apertures are preferably capped by temperature compensation mechanisms.

Bridge apertures are located, whenever possible, away from the cylinders' endwalls in order to avoid coupling undesirable higher order modes between the cavities. Keeping this in mind, for TE114 and higher order TE11X modes, bridge couplings are preferably placed at any E field null other than those occurring at endwalls. For TE113 modes, a bridge aperture will preferably be located at the only E field null location that does not coincide with an endwall of either cylinder. Although additional bridge apertures may be included, any additional bridges will tend to couple some component of undesirable higher order mode energy from one cylinder to another and so should be avoided wherever possible. Nevertheless the severity of interference from unwanted modes is lowest for TE113 and increases with increasing TE11X mode.

Not only will the new filter accommodate any TE11X mode, a filter having any desired number of sections may be implemented using the new parallel cylinder design. Filter sections may be added by extending cylinders, placing additional walls within each cylinder to create additional cavities and forming coupling apertures where appropriate. Sections may also be added by forming additional cylinders in parallel with the first two and placing coupling apertures within common walls, or by a combination of these approaches.

These and other features, aspects and advantages of the invention will be apparent to those skilled in the art from the following detailed description, taken together with the accompanying drawings.

DETAILED DESCRIPTION OF THE INVENTION

The new microwave filter aligns cylindrical resonant cavities, preferably made of aluminum, along parallel longitudinal axes and couples energy between the cavities through mainline and bridge apertures formed in a common wall between the cylinders. The cylinders are preferably offset along these axes in order to permit the inclusion of flanges for the attachment of temperature compensation devices such as those disclosed in U.S. Pat. No. 4,677,403 to Kich. Although these flanges could be formed without offsetting the cylinders, by incorporating them into a cylinder housing for example, the cylinders would then be forced apart and the common wall through which energy is coupled would be thicker, the apertures through which energy is coupled would be thicker and, as a result, the bandwidth of the filter would be restricted. Alternatively, conductive materials having lower thermal coefficients of expansion than aluminum could be employed to form the cylinders, thus obviating the temperature compensation devices, but such materials, e.g. nickel-steel alloys such as INVAR, tend to be significantly denser, more expensive, and more difficult to work than aluminum. In those embodiments where a temperature compensation flange is not included the cylinders need not be offset.

The new filter design supports any TE11X mode, including TE113 and TE114, which are commonly used in satellite communications systems. Additionally, the number of sections within the filters may be expanded by adding cavities to each cylinder, by joining more than two cylinders along parallel longitudinal axes, or by a combination of these methods.

Figure 1:
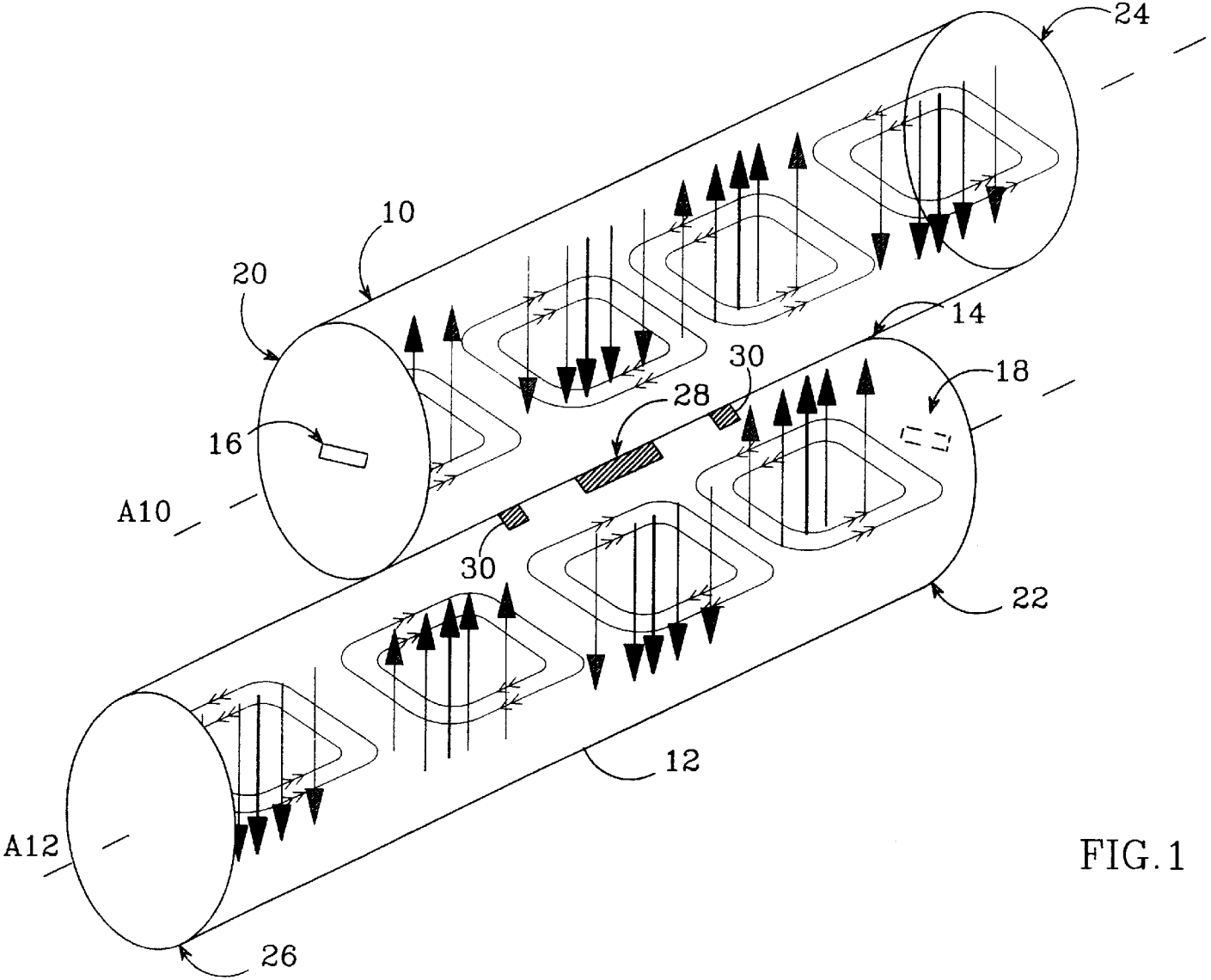
FIG. 1 is a perspective view of cylindrical resonators arranged to form a TE114 filter according to the present invention.

In the illustrative embodiment of FIG. 1, two right cylindrical resonators 10 and 12 aligned along respective parallel axes A10 and A12 share a common wall 14 for a substantial portion of their lengths. Horizontal apertures 16 and 18 are formed in opposing endwalls 20 and 22 of the resonators 10 and 12, respectively. Although, in general, either aperture may act as an input or output aperture, for the sake of clarity and convenience the following discussion will assume that the filter is not symmetrical and that apertures 16 and 18 are input and output apertures, respectively. Similarly, resonators 10 and 12 will be referred to as input and output resonators, respectively. Additionally, generally any endwall may include an input or output aperture, e.g., endwalls at the same ends of the cylinders, rather than at opposing ends of the cylinders as illustrated in FIG. 1, may include input and output apertures. The input/output apertures are located in opposing ends in this embodiment in order to permit the incorporation of temperature compensation devices within the cylinder ends featuring flanges.

In this illustrative embodiment, the resonators each support TE114 modes, as evidenced by four half-wavelengths represented by four alternating sets of arrows with each set 180° out of phase with adjacent sets. The E field peak locations are represented by thick arrows, lower intensity E fields are represented by narrower arrows. Associated H fields are illustrated as closed loops which encircle the (time-varying) E fields. For clarity only one of the two orthogonal modes is illustrated but, as discussed in more detail in relation to FIG. 2, E fields which are in phase with, but orthogonal to the illustrated E field establish corresponding H fields which are orthogonal to the illustrated H fields.

The resonators 10 and 12 are offset with respect to one another by one half-wavelength at either cylinder end. This arrangement aligns the input endwall 20 with an E field null within the output cylinder. A signal is introduced to the cylinders 10 and 12 through the input aperture 16 and establishes the illustrated mode pattern with, in this TE114 example, E field nulls at either endwall 20,24 and three equally spaced locations in between. Hereinafter, modes introduced from outside a cylinder will be referred to as primary modes, those which result from manipulation of a primary mode E field will be referred to as secondary modes.

It should be noted that other, unwanted, modes are also invariably supported by the cylinders. For example, a TE114 cylinder also supports TE213 and TE312 modes. Since the cylinders are conductive, E field nulls will always be located at the endwalls 20–26. This is true for the undesired modes as well as the desired modes. Although, because mode energy is coupled from cavity to cavity via H fields and because of the orientation of H fields within the cylinders, E field nulls correspond to the preferred locations along the common wall for bridge couplings, the endwall E field nulls also correspond to strong coupling locations for the undesired modes. For this reason bridge apertures are preferably located at the interior E field nulls, i.e., E field nulls not coincident with an endwall. In a TE113 embodiment there is only one such location, but additional energy may be coupled, if necessary, through an aperture located at one of the endwalls. As noted above, interference from unwanted modes is not as severe in a TE113 cylinder as in higher-mode TE11X cylinders.

In the preferred embodiment a longitudinal aperture 28 located in the cylinders' common wall 14 at the second E field peak from the input endwall 20 forms a mainline coupling from the secondary mode of the input cavity (mode 2) to the primary mode of the output cavity (mode 3). Transverse apertures 30 are preferably located at interior E field nulls and operate as bridge apertures, i.e., they couple energy between the primary mode of the input cavity (mode 1) and the secondary mode of the output cavity (mode 4).

The input 16 and output 18 apertures could be implemented as vertical apertures rather than the illustrated horizontal apertures. In that case, the bridge and mainline aperture reverse roles, i.e., the mainline aperture(s) would be transverse and the bridge aperture(s) would be longitudinal.

Figure 2B:
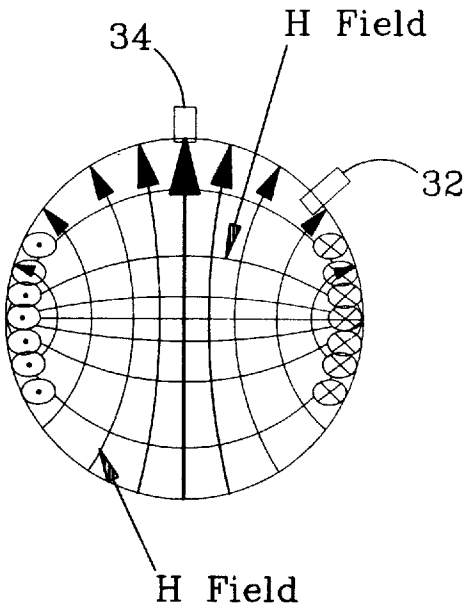
FIG. 2*b* is a sectional end view of a cylindrical resonator which illustrates a primary mode E field pattern and a corresponding H field pattern.
Figure 2A:
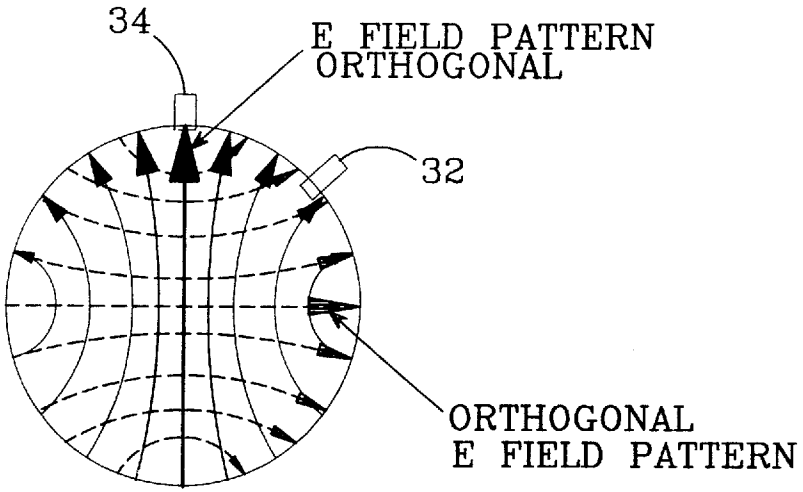
FIG. 2*a* is a sectional end view of a cylindrical resonator which illustrates the orthogonal E field pattern of a dual mode resonator.

The sectional view of FIG. 2*a* illustrates the E field distribution with a dual-mode cavity. A primary mode is characterized by a primary E field pattern represented by vertical arrows of varying thickness, the thickness of which corresponds to the E field density at a given transverse location within the cavity. A coupling screw 32 located at 45° from the primary E field pattern couples energy from the primary mode into an orthogonal secondary mode, which is represented by horizontal E field lines. A tuning screw 34 may be employed to tune, i.e., make minor adjustments to, the modes supported by the cavity. Alternatively, as is known in the art, tuning screws and coupling screws may be positioned at various locations around the perimeter of the cylinder for tuning and/or coupling. The sectional view of FIG. 2*b* illustrates the relationship between a given mode's E field pattern and its associated H field pattern. E field density is once again represented as vertical arrows of varying thickness. The associated H field encircles the E field and is represented by "arrow tails" and "arrow heads" at the locations where the field enters and exits, respectively, the plane of the figure. The coupling screw 32 and tuning screw 34 are as discussed in relation to FIG. 2A.

Figure 3:
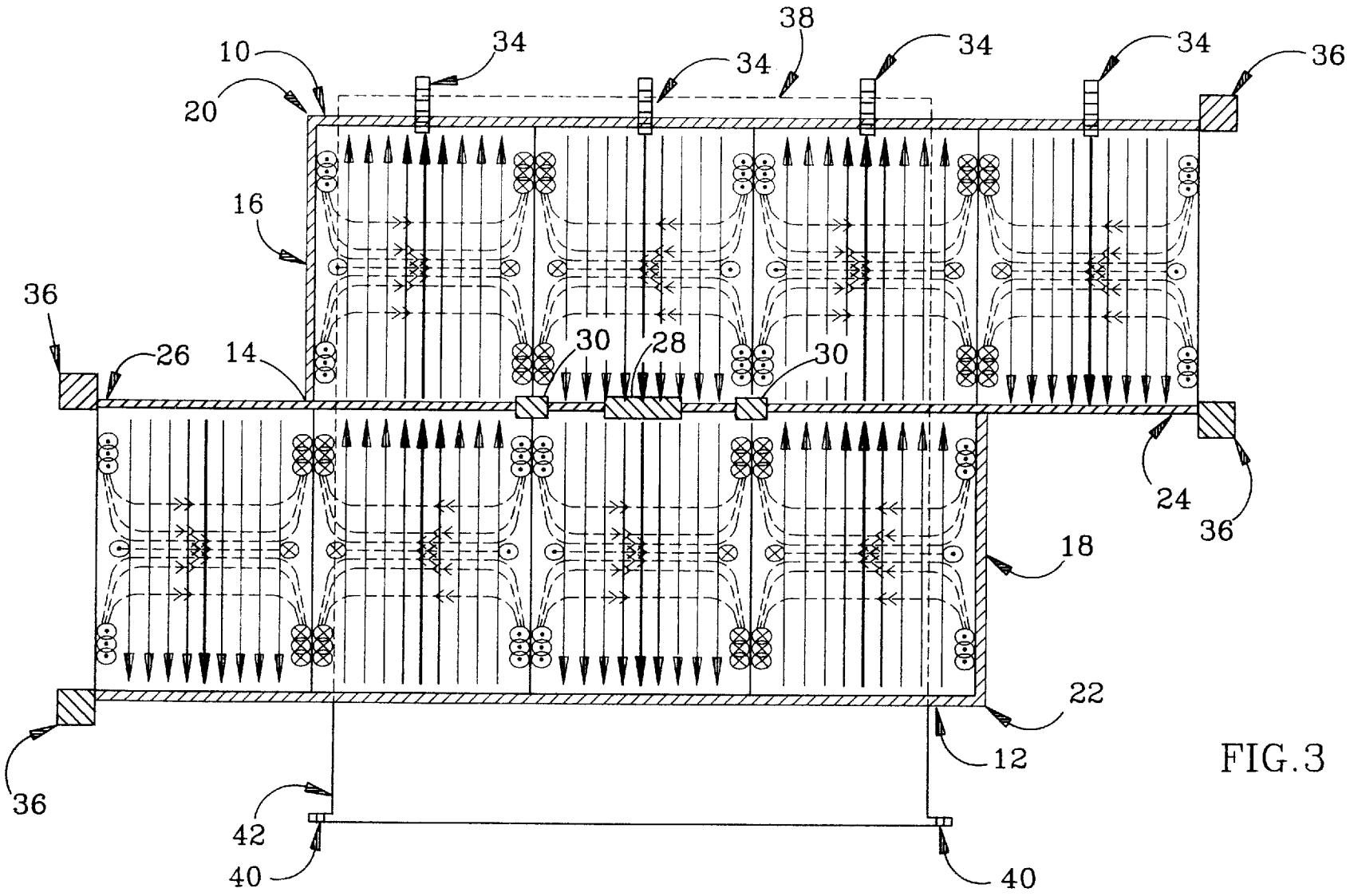
FIG. 3 is a sectional view of resonators arranged to form a TE11X filter according to the present invention.

The sectional view of FIG. 3 illustrates the E- and H field distribution of primary modes within input and output tubes 10 and 12, respectively. Tuning screws 34 are as discussed in relation to FIG. 2, coupling screws and the orthogonal modes they create are not shown for the sake of clarity. Horizontal input and output apertures 16 and 18 couple horizontal H fields into the input cavity 10 and out of the output cavity 12, respectively. Bridge couplings 30 couple energy between the H fields of the primary mode of the input cavity (mode 1) and the secondary mode (mode 4) of the output cavity 12. Mainline coupling 28 couples energy between the H field of the secondary mode of the input cavity (mode 2, not illustrated) and the primary mode of the output cavity (mode 3, not illustrated). As noted in the discussion related to FIG. 1, bridge coupling apertures are preferably located at interior E field minima of the input cavity's primary mode.

Clearly, the aperture thickness of an inter-cavity coupling, and consequently the filter's bandwidth, is determined by the thickness of the common wall 14. Furthermore, flanges 36, which position temperature compensation devices at cavity endwalls 24 and 26, would force the cavities further apart, thickening the common wall 14, were it not for the offset between the input and output cavities. In the preferred embodiment, a substantially solid block housing 38 encloses a substantial portion of the cavities 10,12 and provides a high thermal conductivity path for heat dissipation from the cavities to a mounting structure which would, in turn, act as a heat sink. Threaded holes 40 in the foot 42 of the housing provide for screwing the housing to a mounting structure. Broken lines descending from the output cavity and to the left of both the input and output cavities indicate that more cavities could be added to those illustrated in order to form a filter with more sections than the quasi-elliptic 4,2,0 filter illustrated.

In operation, signals to be filtered are coupled into the input cavity 10 through input coupling 16 and transformed into mode 2 through use of a coupling mechanism such as a screw coupling 32. Energy from mode 2 is coupled into mode 3 via the longitudinal aperture 28 located at the second electric field peak, which couples the magnetic field component of mode 2 into the magnetic field component of mode 3. Additionally, at least one transverse aperture 30 located at an internal, i.e., not at an endwall, electric field minimum couples the transverse magnetic field component of mode 1 into mode 4. This coupling constitutes the bridge coupling of a 4,2,0 quasi elliptic microwave filter.

Figure 4:
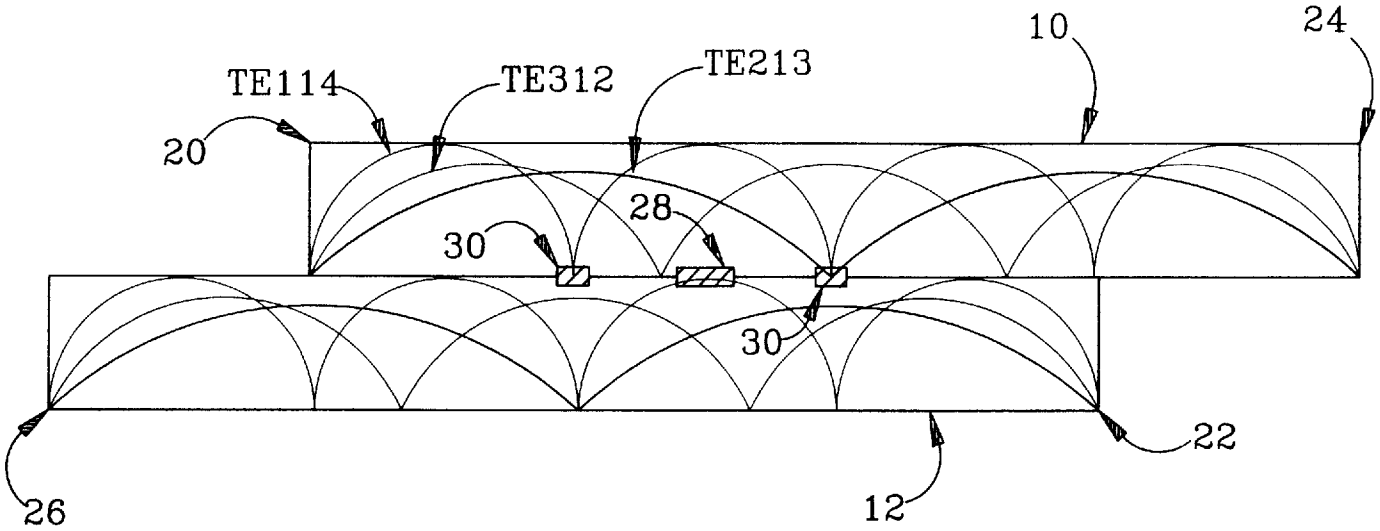
FIG. 4 is a schematic representation of offset cavities according to the present invention which illustrates the E field peak and null distribution of TE114, TE213 and TE312 modes within TE114 cavities.

The distribution of E field peaks and nulls within a two cylinder dual mode quasi elliptic filter implemented according to the present invention are illustrated in the schematic diagram of FIG. 4. In this exemplary embodiment, TE114 modes are preferred, TE213 and TE312 modes are unwanted, in part, because they tend to "de-tune" a filter as the filter's temperature varies. Mainline 28 and bridge 30 couplings are located, as in previous illustrations, at respective peaks and nulls of the primary TE114 mode E field distribution. As noted in the discussion related to FIG. 1, all the illustrated modes, TE114, TE312, and TE213, have E field nulls at endwalls 20–26. Additionally, the second interior E field nulls of modes TE114 and TE213 from the left of the figure coincide. Since these E field nulls correspond to preferred bridge coupling sites for the input cavity's primary modes, the first interior TE114 E field null from the input endwall 20 is preferred for bridge coupling. If additional coupling is required for a given filter, the location of the second interior TE114 E field null from the input endwall may be employed to couple more energy between modes 1 and 4. However, this coupling location provides a good coupling location for the TE213 mode as well and should be avoided if possible.

Figure 5:
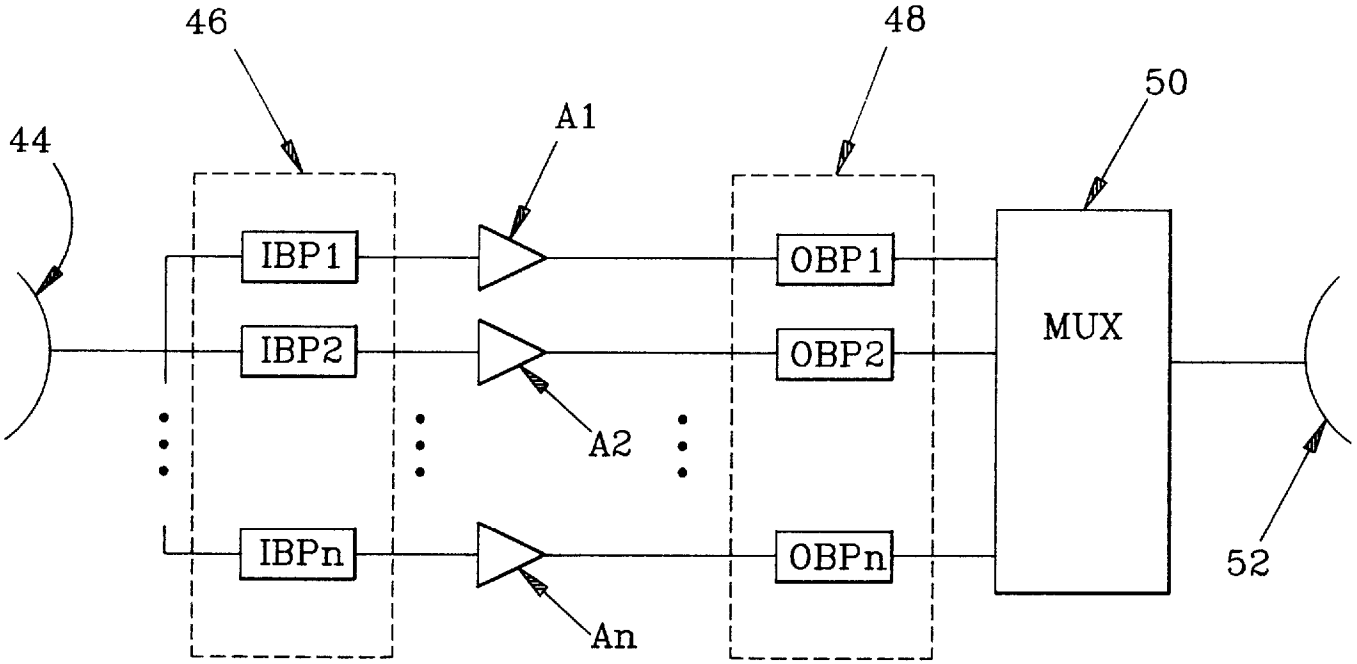
FIG. 5 is a block diagram of a microwave transceiver which employs the new TE11X filter.

Although the new filter may be employed in a variety of microwave applications, it is particularly suited to operation with a satellite transceiver such as the one illustrated in block diagram form in FIG. 5. In a rudimentary "bent pipe" transceiver such this one, signals are received by a satellite, from an earth station for example, then amplified and transmitted to another earth station. The satellite transceiver forms a link in a communications chain which may envelope the globe. On board the satellite a receiving antenna 44 receives radio frequency signals and transmits the received signal to a filter bank where the signal is band-pass filtered to separate it into constituent channels by bandpass filters IBP1–IBPn. The filtered signals are then routed to respective amplifiers A1–An which amplify the individual channels. The amplified signals are transmitted to an output filter bank 48 where they are bandpass filtered and transmitted to a multiplexer 50 which combines the several channels into one signal which is then transmitted by the transmitting antenna 52 to an earth station or another satellite. The new filter may be advantageously employed as any of the illustrated bandpass filters, IBP1–IBPn or OBP1–OBPn.

The forgoing description of specific embodiments of the invention has been presented for the purposes of illustration and description. It is not intended to be exhaustive or to limit the invention to the precise forms disclosed, and many modifications and variations are possible in light of the above teachings. Resonant cylinders having parallel longitudinal axes, sharing a common wall and employing the disclosed coupling techniques may be employed as directional couplers or RF combiners, for example. The embodiments were chosen and described in order to best explain the principles of the invention and its practical application, to thereby enable others skilled in the art to best utilize the invention. It is intended that the scope of the invention be limited only by the claims appended hereto.

I claim:

1. A cylindrical multi-cavity microwave filter comprising:

a first right-cylindrical resonator for supporting primary and secondary TE11X mode electromagnetic resonances, where X is an integer greater than or equal to 3, said resonator having endwalls at either end and an input aperture formed in one end wall, a second right-cylindrical resonator for supporting primary and secondary TE11X mode electromagnetic resonances, said second resonator having endwalls at either end and an output aperture formed one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy between the magnetic field of the secondary resonance mode of the second resonator and the magnetic field of the primary resonance mode of the first resonator.

2. The cylindrical multi-cavity microwave filter of claim 1, wherein said output aperture is formed in the endwall of said second resonator at the opposite end from the input aperture of the first resonator.

3. The filter of claim 1, wherein said bridge aperture is located at a null of resonance modes of higher order than TE11X modes.

4. The filter of claim 1, wherein the cylinder ends which have neither input nor output apertures formed in the respective endwalls include temperature compensation flanges for accommodation of temperature compensation devices.

5. The filter of claim 1, wherein said at least one bridge aperture comprises at least two bridge apertures which are located at internal minima of the first resonator's said secondary resonance mode electric field strength.

6. The filter of claim 1, wherein both resonators support TE114 resonant modes and one of said at least one bridge apertures is located at the first internal electric field minimum from the input aperture.

7. A cylindrical multi-cavity microwave filter comprising:

a first right-cylindrical resonator for supporting primary and secondary TE11X mode electromagnetic resonances, where X is an integer greater than or equal to 3, said resonator having endwalls at either end and an input aperture formed in one end wall, a second right-cylindrical resonator for supporting primary and secondary TE11X mode electromagnetic resonances, said second resonator having endwalls at either end and an output aperture formed one endwall, said resonators formed such that their longitudinal axes are parallel and they share a common wall along the longitudinal direction, both resonators arranged to support TE114 resonant modes, a mainline aperture formed in said shared wall to couple energy from the magnetic field of a secondary resonance mode of the first resonator to the magnetic field of a primary resonance mode of the second resonator, and bridge apertures formed in said shared wall to couple energy between the magnetic field of the secondary resonance mode of the second resonator and the magnetic field of the primary resonance mode of the first resonator, said bridge apertures including a first bridge aperture located at the first internal electric field minimum from the input aperture, and a second bridge aperture located at the second internal electric field minimum from the input aperture.

8. The filter of claim 1, wherein both resonators support TE113 resonant modes and one of said at least one bridge apertures is located at the first internal electric field minimum from the input aperture.

9. The filter of claim 1, wherein said resonators form four resonant cavities.

10. A cylindrical cavity microwave filter comprising:

a first right-cylindrical resonator for supporting primary and secondary TE11X mode electromagnetic resonances, said resonator having endwalls at either end and an input aperture formed in one end wall, a second right-cylindrical resonator for supporting primary and secondary TE11X mode electromagnetic resonances, said second resonator having endwalls at either end and an output aperture formed in one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy from the magnetic field of the secondary resonance mode of the second resonator to the magnetic field of the primary resonance mode of the first resonator, said resonators offset along their longitudinal axes from one another so as to align said apertures with preferred electric field intensities.

11. The cylindrical cavity microwave filter of claim 10, wherein an output aperture is formed at the opposite end of the second resonator from that of the input aperture of the first resonator.

12. A cylindrical cavity microwave filter comprising:

a first right-cylindrical resonator for supporting primary and secondary TE114 mode electromagnetic resonances, said resonator having endwalls at either end and an input aperture formed in one end wall, a second right-cylindrical resonator for supporting primary and secondary TE114 mode electromagnetic resonances, said second resonator having endwalls at either end and an output aperture formed in one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy from the magnetic field of the secondary resonance mode of the second resonator to the magnetic field of the primary resonance mode of the first resonator, said resonators offset along their longitudinal axes from one another so as to align the mainline aperture with a second-from-the-input-endwall electric field intensity peak and to align the bridge aperture with the first-from-the-input-endwall or -output-endwall electric field intensity minima.

13. The filter of claim 12, wherein said endwalls are offset by one half a TE114 wavelength.

14. A cylindrical cavity microwave filter comprising:

a first right-cylindrical resonator for supporting primary and secondary TE113 mode electromagnetic resonances, said resonator having endwalls at either end and an input aperture formed in one end wall, a second right-cylindrical resonator for supporting primary and secondary TE11X mode electromagnetic resonances, said second resonator having endwalls at either end and an output aperture formed in one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy from the magnetic field of the secondary resonance mode of the second resonator to the magnetic field of the primary resonance mode of the first resonator.

15. A satellite communications transceiver, comprising:

a multiplexer, a plurality of right cylindrical resonant cavity transmitting filters connected to filter input signals and to provide filtered output signals to respective inputs of said multiplexer which combines said filtered signals into a multiplexed signal, and a transmitting antenna connected to receive the filtered, multiplexed signals from said multiplexer and to transmit said multiplexed signal, each of said filters comprising:

a first right-cylindrical resonator for supporting primary and secondary TE11X mode electromagnetic resonances, said resonator having endwalls at either end and an input aperture formed in one end wall, a second right-cylindrical resonator for supporting primary and secondary TE11X mode electromagnetic resonances, said second resonator having endwalls at either end and an output aperture formed in one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy from the magnetic field of the secondary resonance mode of the second resonator to the magnetic field of the primary resonance mode of the first resonator.

16. The communications transceiver of claim 15, further comprising:

a receiving antenna connected to receive a radio frequency signal, a plurality of receiving filters connected to filter said received signal, each of said receiving filters comprising:

a first right-cylindrical resonator for supporting primary and secondary TE11X mode electromagnetic resonances, said resonator having endwalls at either end and an input aperture formed in one end wall, a second right-cylindrical resonator for supporting primary and secondary TE11X mode electromagnetic resonances, said second resonator having endwalls at either end and an output aperture formed in one endwall, said resonators formed such that they are non-coaxial, their longitudinal axes are parallel and they share a common wall along the longitudinal direction, a mainline aperture formed in said shared wall to couple energy from the magnetic field of a secondary resonance mode of the first resonator to the magnetic field of a primary resonance mode of the second resonator, and at least one bridge aperture formed in said shared wall to couple energy from the magnetic field of the secondary resonance mode of the second resonator to the magnetic field of the primary resonance mode of the first resonator, and a plurality of amplifiers connected to receive said filtered output signals from respective receiving filters, to amplify said signals, and to transmit said signals to said transmitting filters.

17. The transceiver of claim 16, wherein said at least one bridge aperture is located at a null of resonance modes of higher order than TE11X modes.

18. The transceiver of claim 17, wherein the cylinder ends which have neither input nor output apertures formed in the respective endwalls include temperature compensation flanges for accommodation of temperature compensation devices.

19. The transceiver of claim 18, wherein said at least one bridge aperture comprises at least two bridge apertures which are located at internal minima of the first resonator's said secondary resonance mode electric field strength.

20. The transceiver of claim 16, wherein both resonators support TE114 resonant modes and one of said at least one bridge apertures is located at the first internal electric field minimum from the input aperture.

21. A satellite communications transceiver, comprising:

a multiplexer, a plurality of right cylindrical resonant cavity transmitting filters connected to filter input signals and to provide filtered output signals to respective inputs of said multiplexer which combines said filtered signals into a multiplexed signal, a transmitting antenna connected to receive the filtered, multiplexed signals from said multiplexer and to transmit said multiplexed signal, a receiving antenna connected to receive a radio frequency signal, a plurality of receiving filters connected to filter said received signal, and a plurality of amplifiers connected to receive said filtered output signals from respective receiving filters, to amplify said signals, and to transmit said signals to said transmitting filters, each of said transmitting and receiving filters comprising:

a first right-cylindrical resonator for supporting primary and secondary TE11X mode electromagnetic resonances, said resonator having endwalls at either end and an input aperture formed in one end wall, a second right-cylindrical resonator for supporting primary and secondary TE11X mode electromagnetic resonances, said second resonator having endwalls at either end and an output aperture formed in one endwall, said resonators formed such that their longitudinal axes are parallel and they share a common wall along the longitudinal direction, both resonators arranged to support TE114 resonant modes, a mainline aperture formed in said shared wall to couple energy from the magnetic field of a secondary resonance mode of the first resonator to the magnetic field of a primary resonance mode of the second resonator, and bridge apertures formed in said shared wall to couple energy between the magnetic field of the secondary resonance mode of the second resonator and the magnetic field of the primary resonance mode of the first resonator, said bridge apertures including a first bridge aperture located at the first internal electric field minimum from the input aperture, and a second bridge aperture located at the second internal electric field minimum from the input aperture.

22. The filter of claim 16, wherein both resonators support TE113 resonant modes and one of said at least one bridge apertures is located at the first internal electric field minimum from the input aperture.

23. The transceiver of claim 16, wherein said resonators form four resonant cavities.

* * * * *